US005248104A

United States Patent [19]

Groos et al.

[11] Patent Number: 5,248,104

[45] Date of Patent: Sep. 28, 1993

[54] WIRE-UNWINDING DEVICE

[75] Inventors: Heinrich Groos, Herborn; Hans Hermanni, Sinn-Fleisbach; Jürgen Gerlach, Herborn-Merkenbach, all of Fed. Rep. of Germany

[73] Assignee: Berkenhoff GmbH, Heuchelheim, Fed. Rep. of Germany

[21] Appl. No.: 714,884

[22] Filed: Jun. 14, 1991

Related U.S. Application Data

[63] Continuation-in-part of Ser. No. 600,142, Oct. 17, 1990, abandoned, which is a continuation of Ser. No. 345,395, Apr. 28, 1989, abandoned.

[30] Foreign Application Priority Data

May 3, 1988 [EP] European Pat. Off. ..... 88107043.7

[51] Int. Cl.[5] ..... B65H 49/34

[52] U.S. Cl. ..... 242/45

[58] Field of Search ..... 242/45, 78, 78.6, 79, 242/41, 156, 156.2

[56] References Cited

U.S. PATENT DOCUMENTS

| | | | |
|---|---|---|---|
| 1,946,313 | 2/1934 | Daniels | 242/156.2 |
| 1,959,680 | 5/1934 | Livingston | 242/45 |
| 2,006,819 | 7/1935 | Zschach | 242/45 |
| 2,503,995 | 4/1950 | Bouget | 242/79 |
| 2,741,437 | 4/1956 | Haworth | 242/45 |
| 2,844,773 | 7/1958 | Turner et al. | 242/45 |
| 2,981,491 | 4/1961 | Eans, Jr. | 242/45 |
| 3,101,912 | 8/1963 | Bartlett | 242/156.2 X |
| 3,556,373 | 1/1971 | Whitney | 226/117 |
| 3,797,771 | 3/1974 | Brown et al. | 242/7.12 X |
| 3,994,445 | 11/1976 | Tarulli | 242/45 |
| 4,007,884 | 2/1977 | Schippers et al. | 242/41 |
| 4,530,471 | 7/1985 | Inoue | 242/45 |
| 4,899,945 | 2/1990 | Jones | 242/45 |
| 4,967,973 | 11/1990 | Murnane | 242/45 |

FOREIGN PATENT DOCUMENTS

| | | |
|---|---|---|
| 1025169 | 12/1953 | Fed. Rep. of Germany . |
| 1361522 | 4/1963 | France . |
| 1549653 | 12/1967 | France . |
| 385774 | 9/1960 | Sweden . |
| 2149432A | 6/1985 | United Kingdom . |

*Primary Examiner*—Stanley N. Gilreath
*Attorney, Agent, or Firm*—Flynn, Thiel, Boutell & Tanis

[57] ABSTRACT

A wire-unwinding device in which wire can be unwound from a very large wire drum such that the direction of curvature of the wire is maintained and alternating bendings of the wire are avoided. The wire is guided over a stationary first guide pulley, a second guide pulley, which is changeable in position in order to apply an initial tensioning force, and over a further stationary third guide pulley.

11 Claims, 4 Drawing Sheets

WIRE-UNWINDING DEVICE

CROSS REFERENCE TO RELATED APPLICATIONS

This application is a continuation in part of application Ser. No. 07/600 142, filed Oct. 17, 1990, now abandoned, which is a continuation of U.S. Ser. No. 07/345 395, filed Apr. 28, 1989, now abandoned.

FIELD OF THE INVENTION

The invention relates to a wire-unwinding device with a for receiving a wire drum.

BACKGROUND OF THE INVENTION

Wire-unwinding devices are known from the state of the art. In particular, it is known for a wire drum, onto which wire is wound, to be rotatably supported so that the wire can be removed. It is necessary in a wire-unwinding device that the wire is unwound in a controlled manner. A predetermined wire tension must be assured in order to avoid loop formations or wire tears. The known wire-unwinding devices also have the disadvantage of not permitting large wire drums to be unwound in a reliable manner. Furthermore, known wire-unwinding devices do not guarantee that a change of the mechanical characteristics of the wire will be avoided.

A wire-unwinding machine is known from Swiss Patent No. 385 774, which is used to wind wires onto drums. This known device has a stationary guide roller or pulley rotatably supported on the housing. A guide pulley, which is changeable in position, is arranged in an area between the wire drum and the stationary guide pulley, with the wire being guided over the rollers in such a manner that its pregiven direction of curvature is maintained. Such a device is, however, not suited for use in spark eroding, electrical discharge machines for electric and also for driving reasons.

The basic purpose of the invention is to create a wireunwinding device for use with wire spark eroding, electrical discharge machines which, with a simple design and reliable operation, can also be equipped with very large wire drums and in which an influence of the mechanical characteristics or of the strength characteristics of the wire is avoided and which is suited for feeding the wire to the wire spark eroding machines in all occurring operating conditions.

SUMMARY OF THE INVENTION

The purpose is attained inventively by rotatably supporting a stationary first guide pulley on the housing, by arranging a second guide pulley, which is changeable in position, rotatably in an area between the wire drum and the stationary first guide pulley, by guiding the wire unwound from the wire drum in the direction of curvature predetermined by the wire drum over the stationary first pulley, the second movable guide pulley, and thereafter over a stationary third guide pulley, by the guide pulleys and all structural elements coming into contact with the wire being constructed or arranged so as to be electrically insulated and by the motor driving the shaft of the unwinding device being reversibly operable and in response to a location of the second guide pulley relative to a predetermined and set location thereof.

The inventive wire-unwinding device has a number of significant advantages. The arrangement of the guide pulleys and the inventive type of guiding of the wire assures that the wire has at all times a sufficient tension so that, on the one hand, the wire does not unwind too quickly from the wire drum and thus a loop formation is avoided, and that, on the other hand, the wire is prevented from tearing caused by excessive stresses. Since the wire from the wire drum is guided over the movable second guide pulley and thereafter over the stationary third guide pulley, it is possible to assure at all times a sufficient tension of the wire by shifting the movable second guide pulley. This occurs independently from the size of the utilized wire drum or of the amount of wire on the drum. The arrangement of the wire drum and of the guide pulleys furthermore permits an unwinding of the wire from the wire drum and a guiding of the wire to a following working or processing station in such a manner that the wire is guided around the guide pulleys exclusively in the direction of curvature predetermined by the wire drum. Thus, it is avoided that the wire, during the unwinding operation, is exposed to alternating bendings. This is particularly advantageous when the inventive wire-unwinding device is used in connection with a spark eroding, electrical discharge machine, for example for spark-erosive cutting, since the stiffness or strength of the wire, which is decisive for the eroding behavior, is not influenced. The wire thus remains substantially in the direction of curvature pregiven by the winding process onto the wire drum, it is bent as rectilinearly as possible during its guidance around the guide pulleys, however, it is not exposed to alternating bendings. By suitably dimensioning the guide pulleys, it is additionally possible to avoid an excessive bending of the wire in the direction of curvature. The guide pulleys can according to the invention have very large diameters, for example a diameter which corresponds with the medium diameter of the wire drum. The inventive wire-unwinding device thus facilitates an extremely good material-protective unwinding of the wire.

A further important advantage of the inventive wire-unwinding device exists in very large wire drums being able to be processed which, over a long period of time, facilitates a substantially unsupervised operation of the unwinding device. This is particularly advantageous when an after-connected machine, for example a spark eroding, electrical discharge machine, is operated unsupervised during a night shift or over the weekend. The inventive guiding, tension controlling and storing of the wire assures that breakdowns in operation caused by the wire-unwinding device cannot occur.

A particularly advantageous further development of the inventive device exists in the movable guide pulley being supported initially tensioned in a direction of translation for applying an initial stressing force on the wire. This measure assures that a sufficient force is at all times applied to the wire in order to prevent vibrations or loop formations so that, as already described, alternating bends of the wire are avoided.

It is furthermore particularly advantageous, when the stationary first and third guide pulleys are constructed as a double pulley and the movable second guide pulley is arranged below the stationary guide pulleys so that the wire is guided from the wire drum over one part of the double pulley, over the movable guide pulley and over the other part of the double pulley. The wire is thus moved in a loop path without alternating bends being applied to the wire. By designing the stationary guide pulleys as a double pulley, a double guiding of the wire occurs resulting in a significant increase in the operating safety, since the wire is guided safely both during the feeding to the movable guide pulley and also during a movement away from the movable guide pulley. It has proven to be particularly advantageous to support the movable guide pulley on a vertically movable carriage, since it is possible to initially tension the carriage either by means of an elastic element or by the influence of the force of gravity away from the stationary guide pulleys. Thus, it has been achieved that a constant force for tensioning of the wire is at all times applied, which can reliably balance variations in the tensile force. The wire is thereby prevented from jumping off from the guide pulley and tearing due to sudden, short-term increases in the tensile force.

A wire guide is provided advantageously between the wire drum and the guide pulley, which wire guide includes preferably two rotatably supported rollers. The wire guide causes the wire to always be safely fed to the guide roller, also in the case of wider wire drums.

It is furthermore advantageous when the wire, after the stationary first guide pulley, can be guided over a further elevationally changeable guide pulley, which can be adjusted to an after-connected wire-processing device. By means of the further guide pulley arranged preferably at the upper area of the wire-unwinding device, it is avoided that the wire, after having left the further guide pulley, is subjected to an alternating bending.

A further, particularly favorable development of the inventive wire-unwinding device includes a cantilever supported shaft, on which the wire drum or roll is supported by means of cones which can be guided laterally into a center recess in the wire roll and are supported on the shaft. The wire roll is moved onto the shaft by placing the wire drum, the center recess of which is larger than the diameter of the shaft, on the shaft and moving the wire drum into the unwinding position. It is possible by means of the cones to center the wire drum or roll relative to the shaft. Furthermore, the wire drum is lifted during an installation of the cones, so that the drum lies, for example, no longer on the ground. An elevationally adjustable unwinding shaft is also not needed due to this measure, just like an elevationally adjustable transport device for the wire drum is not needed.

A transport carriage for receiving the wire drum is arranged in a favorable further development below the shaft. The transport carriage can be moved in longitudinal direction of the shaft and includes preferably two parallel, rotatable support rollers. It is possible in a particularly simple manner by means of the transport carriage to move the wire drum into the wire-unwinding device and to support the wire drum on the wire-unwinding device, since a lateral movement of the wire drum is possible without a great amount of force. The rotatable support rollers furthermore make it possible to rotate the wire drum during its positioning, for example in order to bring a driving disk into engagement with the wire drum.

The wire drum, the guide pulleys and all structural elements coming into contact with the wire are in a particularly advantageous development constructed or arranged electrically insulatingly, so that electric current which, for example, during the spark-erosive cutting are applied to the wire, cannot be conducted into the wire-unwinding device.

It is possible according to the invention to drive the shaft and thus the wire roll supported on the shaft steplessly through varying speeds and reversibly by means of a motor. Winding in the reverse direction proves to be advantageous, for example, when structure arranged after the wire-unwinding device is changed, thereby necessitating a large amount of wire to be wound again onto the wire drum. Since the wire is also during the rewinding task guided over the movable guide pulley, it is assured that the rewound wire is wound onto the wire drum with a sufficient amount of tension. The rewinding operation can furthermore be utilized advantageously when a device, which is connected after the wire-unwinding device, has only a small winding capacity for the wire or when the wire is to be used for many purposes.

BRIEF DESCRIPTION OF THE DRAWINGS

The invention will be described hereinafter with reference to one exemplary embodiment and the accompanying drawings, in which.

DETAILED DESCRIPTION

Figure 1:
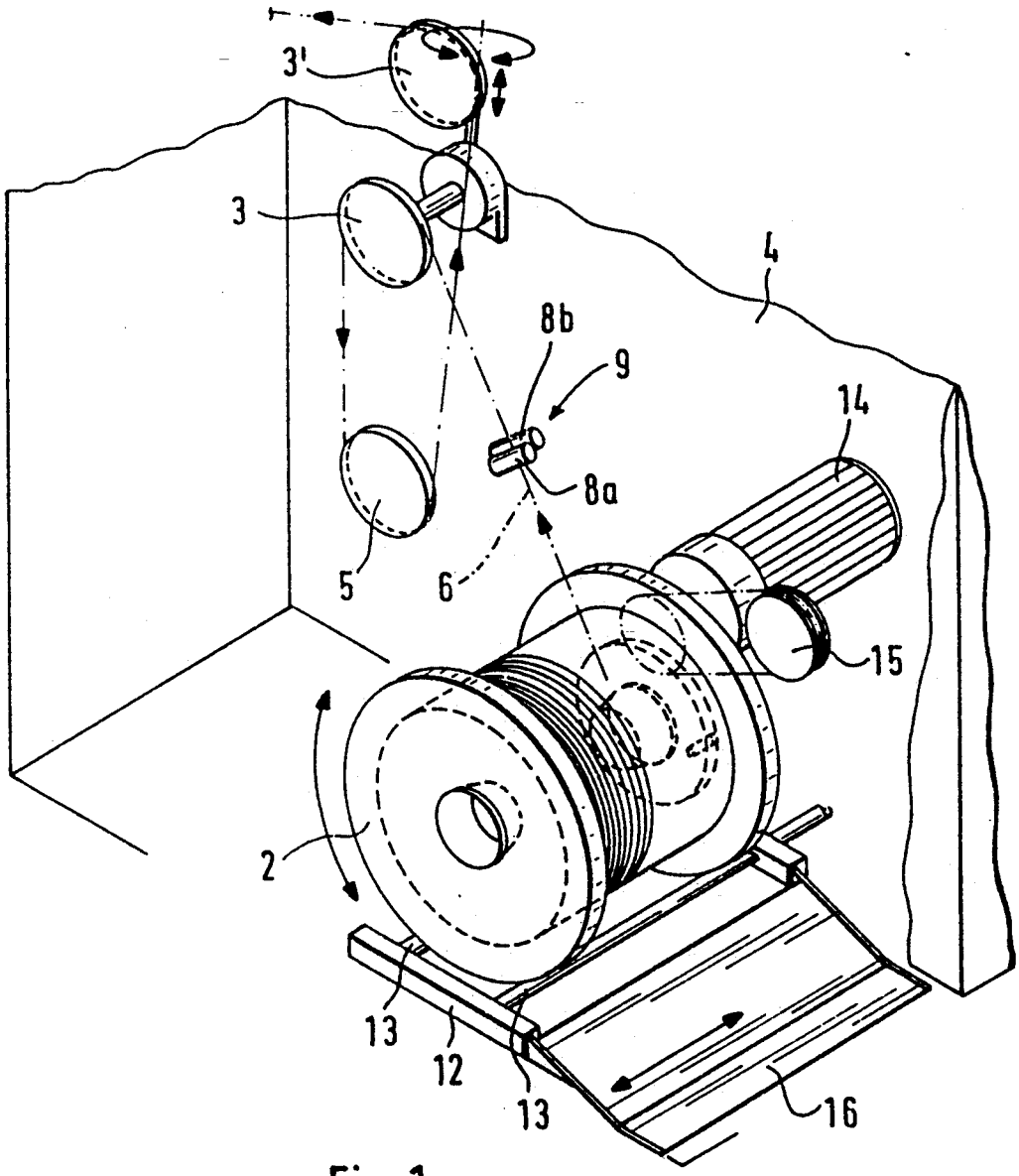
FIG. 1 is a schematic, perspective illustration of one exemplary embodiment of the inventive wire-unwinding device.

FIG. 1 schematically illustrates a first exemplary embodiment of the inventive wire-unwinding device. The wire-unwinding device includes a housing 4 which is only schematically indicated and in which a reversible motor 14 is supported. The motor 14 drives through a transmission 15 a shaft, which is not illustrated in FIG. 1 and on which a wire drum 2 can be supported. The support of the wire drum 2 will be described in detail hereinafter in connection with FIGS. 2 and 3.

FIG. 1 illustrates a transport carriage 12 arranged below the wire drum 2. The transport carriage 12 has two rotatable support rollers 13, which are parallel to one another. The support rollers 13 are supported movably along their axis in the housing 4. A ramp 16 is connected to the carriage 12 and is movable together with the carriage 12. To receive and to move the wire drum 2 into the wire-unwinding device, the carriage 12 together with the ramp 16 is moved laterally until the wire drum 2 is pulled off from the cantilever shaft (not illustrated). It is then easily possible to roll the wire drum over the ramp 16 away from the support roller 13 and to replace it in an analogous fashion with another wire drum.

Figure 2:
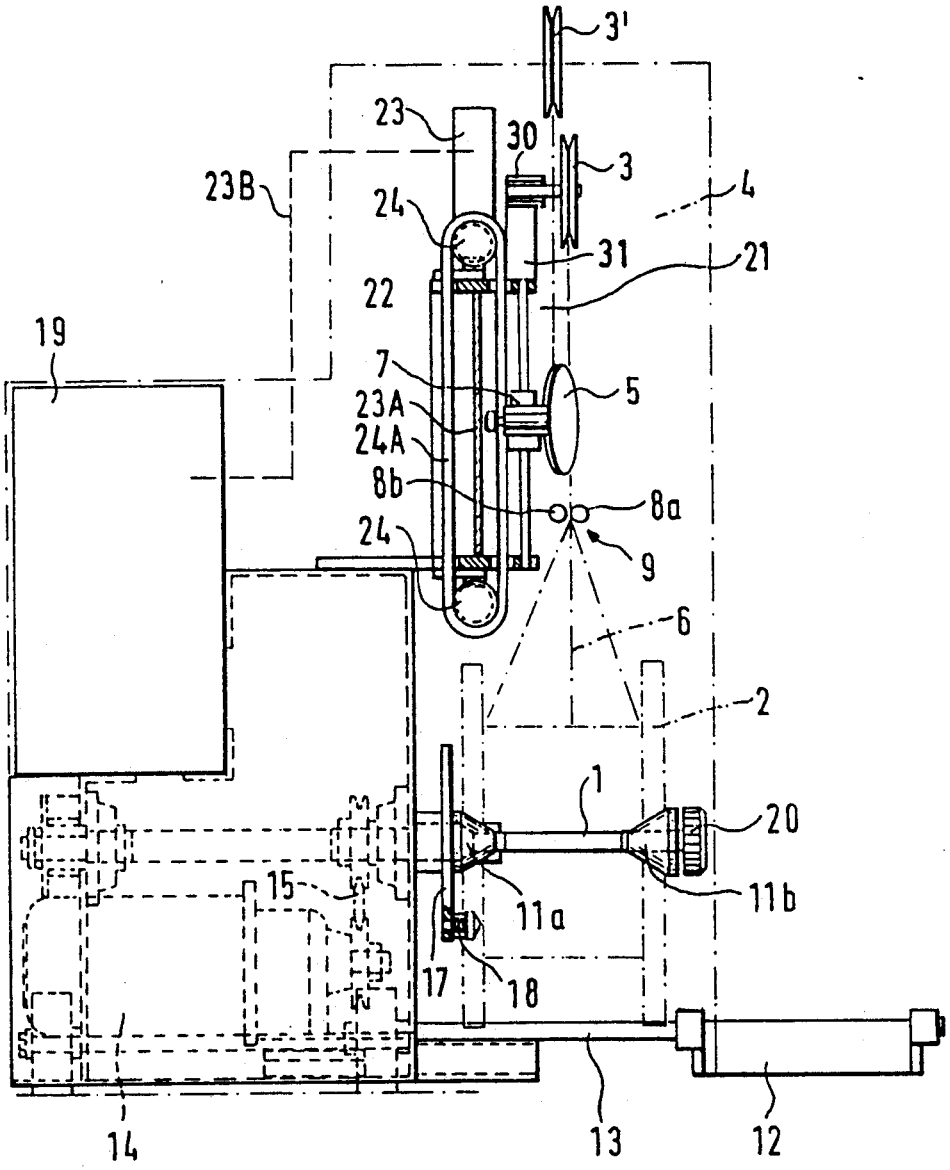
FIG. 2 is a partially cross-sectional, schematic side view of a further exemplary embodiment of the inventive wire-unwinding device.

The wire drum 2 includes in the usual manner several layers of wire 6, which during unwinding from the wire drum 2 is guided between two rotatable rollers 8*a*, 8*b* of a wire guide 9. The wire guide 9 assures that the wire is guided always safely to the next stationary guide roller or pulley 3 in spite of the back and forth movement caused by the arrangement on the wire drum 2. A guide roller or pulley 5, the position of which can be changed, is arranged below the stationary guide pulley 3. The wire is subsequently guided over the guide pulley 5. The wire is thereafter guided over a second stationary guide roller or pulley 3' which, as is schematically illustrated in FIG. 1, is elevationally adjustable and/or swingable through a certain range. According to the invention, it is important that the wire unwound from the wire drum 2 is guided over a movable guide pulley 5, the position of which can be changed and which, as will be described hereinafter, can be raised and lowered from a preset starting position in order to apply at all times a sufficient tension on the wire prior to the wire being guided to a stationary guide pulley, the position of which cannot be changed (in the exemplary embodiment shown in FIG. 1, the guide pulley 3'). The guide pulleys must be arranged such that the direction of curvature of the wire, which direction is predetermined by the wire drum 2, is not changed, so that alternating bendings of the wire are avoided. FIG. 2 is a schematic side view of a further exemplary embodiment of the inventive wire-unwinding device. It can thereby be clearly recognized that the wire drum 2 is supported on a cantilever shaft 1. The shaft 1 is, as is illustrated schematically, operatively connected through the transmission 15 to the motor 14 and is drivable by the motor. The motor 14 is controlled by a control circuit (not illustrated in detail) arranged in a control box 19. The transport carriage 12 has, in the operating condition shown in FIG. 2, been pulled along the support rollers 13 laterally out of the housing 4.

The wire drum 2 has, as already mentioned, a center recess which is larger in diameter than the outside diameter of the shaft 1. A cone 11*a* is secured on the shaft in the area of the driving disk 17. A further cone 11*b* can be moved onto the shaft 1 after the wire drum 2 has been arranged on the shaft 1. The cone 11*b* is urged by a nut 20, which can be screwed onto a thread of the shaft 1, against the wire drum 2 and is guided into the center recess of the wire drum 2. This causes, on the one hand, an exact centering and a lifting of the wire drum. On the other hand, the wire drum is supported by the transport carriage 12 or rather by its support rollers 13, so that the wire drum 2 can rotate freely to facilitate engagement with a drive pin 18 on the driving disk 17.

The two rotatable rollers 8*a*, 8*b* of the wire guide 9 have, for the purpose of a clearer illustration, been illustrated offset below the guide pulley 5 in FIG. 2, whereas they are shown to be above the guide pulley 5 in FIGS. 1 and 3.

Figures 2A, 2B:
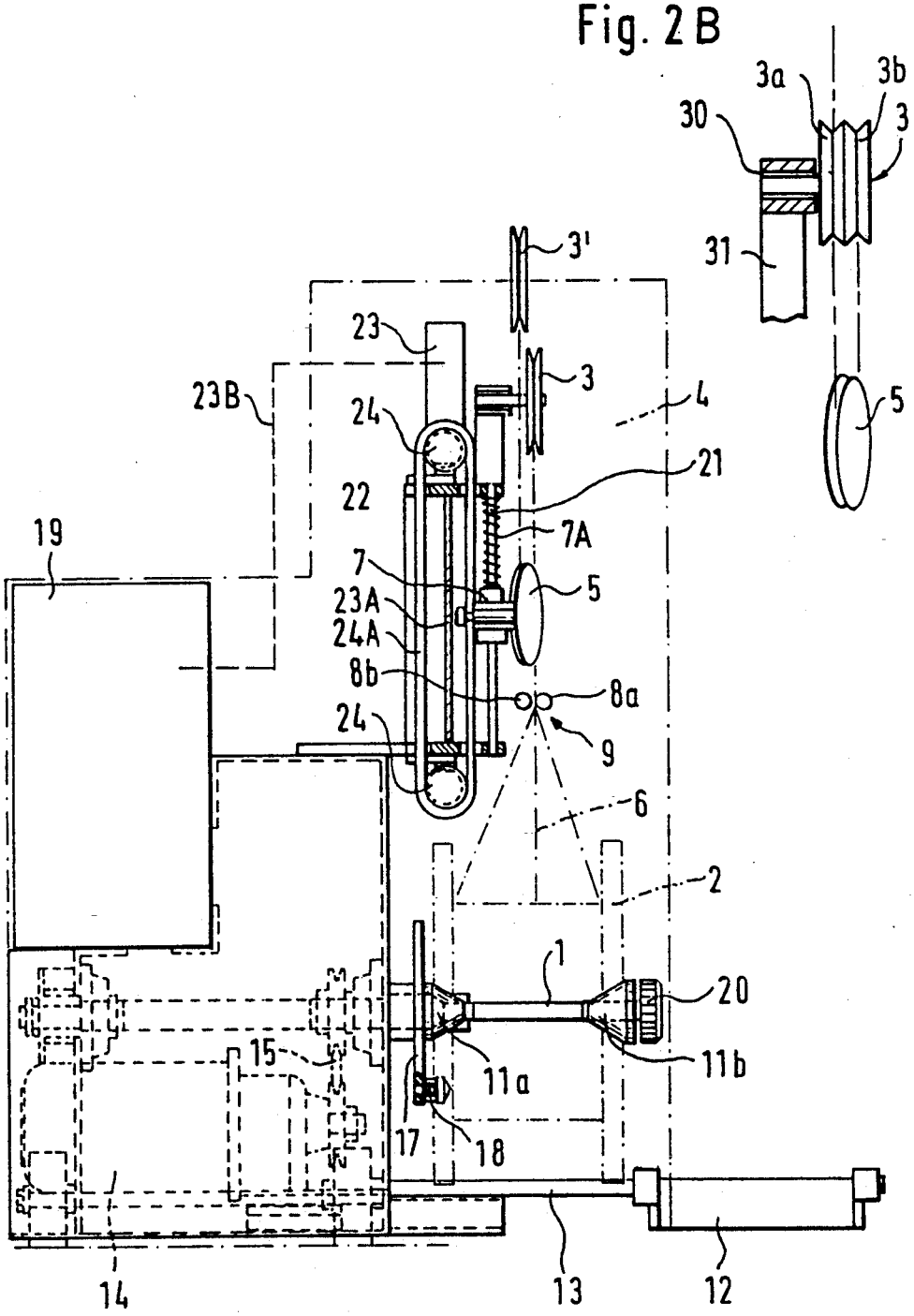
FIG. 2A is a partially cross-sectional, schematic side view of a still further exemplary embodiment of the inventive wire-unwinding device.
FIG. 2B is a fragment of FIG. 2 showing a double pulley arrangement.

Similar to the exemplary embodiment illustrated in FIG. 1, the wire unwound from the wire drum 2 is guided first over a stationary guide pulley 3, then over the guide pulley 5, the position of which can be raised and lowered in response to variations of the tension force applied to the wire, and thereafter over the further stationary guide pulley 3'. The guide pulley 5, the position of which can be changed, as aforesaid, is supported on a carriage 7 which is guided on one or several vertical guide rails 21 and can be moved in the vertical direction. The combined weight of the carriage 7 and the guide pulley 5, the vertical position of which can be changed, as aforesaid, applies an initial tensioning force onto the wire 6. The magnitude of this initial tensioning force can be increased by an elastic element, here a spring 7A (FIG. 2A), or left to the influence of the force of gravity as illustrated in FIG. 2, that is, only the combined weight of the pulley 5 and the carriage 7. A drive mechanism 22 is operatively connected to a travelling nut type potentiometer 23, which nut is driven, for example, by a rotating chain 24A which is guided over spaced sprocket wheels 24 and connected to the carriage 7 by a fastener 24B. More specifically, as tension is applied to the wire, the movable pulley will be urged upwardly from its preset position, preferably a central position between the top and bottom limits imposed by the guide rails, against the force of its own weight and, if present, the force of the spring 7A (FIG. 2A). The carriage 7, on which the pulley is rotatably mounted, is also moved upwardly on the vertical guide rails 21. As a result, the chain 24A is moved by the carriage 7 over the sprockets 24 thereby causing them to rotate. A right angle transmission (not illustrated) converts, for example, a rotation of a selected sprocket 24 into a rotation of a stationary vertical threaded shaft 23A having the travelling nut (not shown) thereon which nut is connected to the slide wire part of the potentiometer to effect the variance of an electrical signal output from the potentiometer 23 transmitted to the control circuitry in the control box 19 through the electrical connection schematically illustrated in broken lines at 23B.

The operation is as follows: If too much wire has been unwound from the spool 1, then the guide roller 5 is lowered from the preset position based on its own weight and, if present, the force of the spring 7A causing, through the carriage 7 and, the chain 24A, the shaft 23A to rotate to move the traveling nut and wiper arm to adjust the potentiometer 23, through which the motor 14 receives a control signal such that the wire unwinding from the drum 2 per unit of time is reduced or, if necessary, the wire is wound up onto the drum until the guide roller 5 again assumes its initial, preferably centered position. A corresponding increase in the amount of wire unwinding from the drum per unit of time occurs in response to an upward movement of the guide roller 5. This structure keeps the wire taut at all times and serves to prevent too much slack from developing between the wire drum and the wire utilizing machine.

The speed and direction rotation of motor 14 is controlled by potentiometer 23 in a conventional manner. For example, rotary movement of the sprocket wheel 24 effects turning of threaded rod 23A to cause a slider (not illustrated) in the potentiometer 23 to move from a central tap or "node" which separates clockwise rotation of the motor from counterclockwise rotation thereof. The carriage 7 is positioned at a centrally located position between the top and bottom limits imposed by the guide rails 2. Movement of the carriage 7 from its centrally located position effects movement of the slider of the potentiometer to result in an increase or decrease, respectively, of the unwinding speed of the motor 14. If operation of the wire utilizing machine is stopped, continued rotation of the wire drum 2 in the unwinding direction slackens the wire and the carriage moves downward to a position wherein the slider in the potentiometer moves past or beyond the central tap or "node" to cause a reversal of the drive motor 14 to rewind wire onto the drum and restore the guide roller to its preferably centered position.

Figure 3:
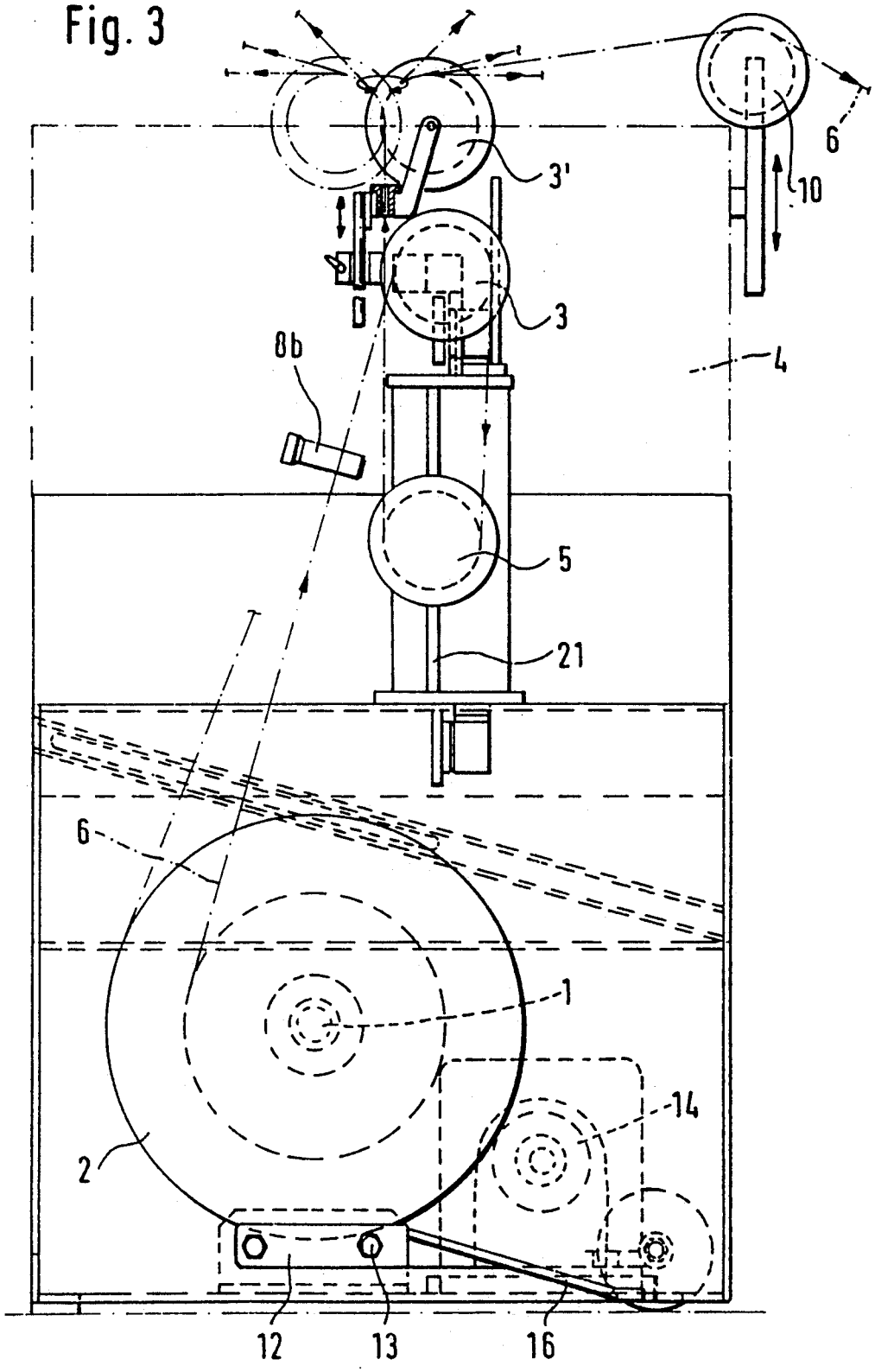
FIG. 3 is a partially cross-sectional, front view of the left side of the exemplary embodiment illustrated in FIG. 2.

FIG. 3 shows a schematic rear view of the exemplary embodiment illustrated in FIG. 2. FIG. 3 shows in particular that the wire 6 is guided from the wire drum 2 over the guide pulleys 3, 5, 3' such that a change of the so far existing direction of curvature does not occur.

The guide pulley 3', different than the guide pulley 5 which can change its position and which continuously moves during operation in order to apply an initial tension on the wire, is stationary after a once occurred adjustment and guides the wire to an adjustable guide pulley 10 which is supported in particular elevationally adjustably on the housing 4. The guide pulley 10 makes it possible to adjust the wire in its unwinding direction to a following processing system in such a manner that the already described bending direction of the wire can be maintained.

Two stationary guide pulleys 3, 3' are used in the exemplary embodiments illustrated in FIGS. 1 to 3, which guide pulleys 3, 3' are arranged separately from one another. In contrast to this, it is also possible to provide only one single stationary guide pulley 3 which is constructed as a double pulley 3*a*, 3*b* (see FIG. 2B) and over which the wire is guided prior to being guided to the guide pulley 5, which is changeable in position as aforesaid, and after having been guided over the guide pulley 5.

Since an electrical voltage is applied to the wire, the stationary guide pulleys 3 and 3', the movable guide pulley 5 and guide rollers 8*a* and 8*b* as well as any other components that come into contact with the wire are insulated from an electrical ground, as by insulation 30 insulating the pulley 3 from the shaft supporting structure 31.

Since the inventive wire-unwinding device can be used to supply many different machines with wire, it can be advantageous to support the housing 4 on fixable rollers. Furthermore, it can be advantageous to close off the area of the housing, in which the wire drum 2 and the guide pulleys are arranged, by means of a door against the surroundings, in order to avoid contaminations of and/or interferences with the unwinding operation.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A wire-unwinding device of ruse with a wire utilizing machine, to which wire electrical voltage is applied, comprising:

a housing means;

a shaft on said housing means adapted to receive thereon a wire drum, said shaft including cone means received into a center recess in the wire drum for centering and supporting the wire drum on said shaft as well as lifting the wire drum relative to said shaft;

at least one stationary first guide roller means rotatably supported on said housing means;

a second guide roller means;

means arranged movably on said housing means in an area between the wire drum and said stationary first guide roller means for facilitating a changing of the position of said second guide roller means in response to variations in tensile force applied to said wire so as to maintain a generally constant force for tensioning said wire extending between the wire drum and the wire utilizing machine and for purposes of keeping said wire taut at all times when said wire is begin supplied to the wire utilizing machine, the wire to be unwound from the wire drum being guided in the direction of curvature predetermined by the wire drum over said at least one stationary first guide roller means sand said second guide roller means and thence to the wire utilizing machine;

means for monitoring the amount of tension in the wire and producing a signal indicative thereof;

electrical insulating means for electrically insulating from an electrical ground, said at least one first guide roller means and said second guide roller means and all structural elements coming into contact with the wire;

a reversible drive means for driving said shaft of said unwinding device to effect, in response to said signal, at least one of a rewinding of wire onto the wire drum and an unwinding of wire therefrom to keep the wire tension at a desired level ;and a laterally movable transport carriage having two parallel, rotatable support rollers for supporting the wire drum for rotation thereon, said laterally movable transport carriage including support means for supporting said laterally movable transport carriage for movement in a direction parallel to a longitudinal direction of said shaft from a position directly below said shaft to a position laterally spaced therefrom to enable the wire drum to be replaced with a different wire drum.

2. The wire-unwinding device according to claim 1, wherein said drive means comprises a stepless speed changing and reversible motor.

3. The wire-unwinding device according to claim 1, wherein said second guide roller includes tension applying means for applying a translator mechanical initial tensioning force onto the wire.

4. The wire-unwinding device according to claim 1, wherein said at least one stationary first guide roller means comprises a double pulley structure, wherein said second guide roller means is arranged below said double pulley structure, and wherein the wire is guided from the wire drum over one pulley of said double pulley structure, over said second guide roller means, and then over the other pulley of said double pulley structure.

5. The wire-unwinding device according to claim 4, including a vertically movable carriage movable toward and away from said stationary first guide roller means; and wherein said second guide roller is supported on said vertically movable carriage.

6. The wire-unwinding device according to claim 5, wherein said vertically movable carriage is initially biased by means of an elastic element away from said at least one stationary first guide roller means.

7. The wire-unwinding device according to claim 5, wherein said vertically movable carriage is initially biased by the influence of the force of gravity away from said at least one stationary first guide roller means.

8. The wire-unwinding device according to claim 1, wherein between the wire drum and said at least one stationary first guide roller means there is arranged a wire guide provided with two rotatably supported rollers.

9. The wire-unwinding device according to claim 1, wherein an elevationally adjustable further guide roller is provided downstream of said second guide roller means for further guiding the wire.

10. The wire-unwinding device according to claim 1, wherein said shaft is cantilever supported on said housing means to facilitate receiving the wire drum thereon.

11. The wire-unwinding device according to claim 1, wherein said wire utilizing machine is a spark eroding, electrical discharge machine.

* * * * *

UNITED STATES PATENT AND TRADEMARK OFFICE

CERTIFICATE OF CORRECTION

PATENT NO. : 5 248 104

DATED : September 28, 1993

INVENTOR(S) : Heinrich GROOS et al.

It is certified that error appears in the above-identified patent and that said Letters Patent is hereby corrected as shown below:

Column 7, line 43; change "of ruse" to read --for use--.

line 44; after "wire" insert ---an---.

line 68; change "sand" to ---and---.

Signed and Sealed this

Fourteenth Day of June, 1994

Bruce Lehman

*Attest:*

BRUCE LEHMAN

*Attesting Officer*

*Commissioner of Patents and Trademarks*